US007097343B2

(12) United States Patent
Tiesler-Wittig et al.

(10) Patent No.: US 7,097,343 B2
(45) Date of Patent: Aug. 29, 2006

(54) LAMP AND HEADLIGHT FOR SIMPLE MOUNTING

(75) Inventors: Helmut Tiesler-Wittig, Tokyo (JP); Leo Wings, Eschweiler (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 19 days.

(21) Appl. No.: 10/500,519

(22) PCT Filed: Dec. 12, 2002

(86) PCT No.: PCT/IB02/05303

§ 371 (c)(1),
(2), (4) Date: Jun. 29, 2004

(87) PCT Pub. No.: WO03/056237

PCT Pub. Date: Jul. 10, 2003

(65) Prior Publication Data

US 2005/0041420 A1 Feb. 24, 2005

(30) Foreign Application Priority Data

Jan. 2, 2002 (DE) ..... 102 00 831

(51) Int. Cl.
*H01R 33/00* (2006.01)

(52) U.S. Cl. ..... 362/651; 362/457; 362/548

(58) Field of Classification Search ..... 362/457, 362/498, 507, 538, 540, 548, 651; 439/57, 439/547; 313/318.01, 318.03, 318.06, 318.07
See application file for complete search history.

(56) References Cited

U.S. PATENT DOCUMENTS

| | | | | |
|---|---|---|---|---|
| 4,812,703 | A * | 3/1989 | Kanematsu et al. | 313/318.07 |
| 6,082,883 | A * | 7/2000 | Tatsumi et al. | 362/519 |
| 6,607,293 | B1 * | 8/2003 | Sanuki et al. | 362/430 |
| 6,710,526 | B1 * | 3/2004 | Helbig | 362/640 |
| 6,981,793 | B1 * | 1/2006 | Behr et al. | 362/651 |

FOREIGN PATENT DOCUMENTS

| | | |
|---|---|---|
| DE | 29823160 | 4/1999 |
| DE | 19815984 | 10/1999 |
| JP | 200077036 | 3/2000 |
| WO | WO9712385 | 4/1997 |
| WO | WO9808021 | 2/1998 |

* cited by examiner

*Primary Examiner*—John Anthony Ward
*Assistant Examiner*—Adam C. Rehm

(57) ABSTRACT

A lamp has projecting stud and resilient elements configured to lock the lamp into a reflector housing upon insertion of the lamp into an opening of the reflector and rotation of the lamp. Electrical connection is also achieved through the rotation where transverse lamp contact elements are brought into engagement with corresponding contacts of the reflector housing.

19 Claims, 5 Drawing Sheets

LAMP AND HEADLIGHT FOR SIMPLE MOUNTING

The invention relates to a lamp and to a headlight, in particular for use in motor vehicle lighting.

A plurality of lamps and headlights with reflector housings and lamps accommodated therein is known. Among the examples are incandescent lamps, such as the known H4 lamp, as well as discharge lamps which are becoming increasingly important in the field of motor vehicles.

The detachable mounting of a lamp in a reflector is to fulfill several requirements. On the one hand, the lamp must be sufficiently strongly anchored mechanically, so that it remains exactly positioned also when exposed to the forces that may be expected in the field of motor vehicles. On the other hand, it should be possible to exchange the lamp in the reflector with little effort.

Particularly important is the exact positioning of the light-generating burner element of the lamp relative to the reflector. The surfaces of modern, specially shaped reflectors is exactly calculated to image a light-generating element, for example an incandescent coil or a gas discharge arc, which is arranged in an exactly defined location. A positioning of the light-generating element deviating from the defined reference point would lead to a strong, undesirable change in the light distribution.

A further requirement is the electrical contacting. This is usually achieved by means of a plug, which is inserted, for example in the case of the known H4 lamp, into axially projecting contact lugs.

DE-A-198 15 984 discloses a headlight with a reflector and a discharge lamp. The discharge lamp is positioned in the reflector in that it projects into the interior of the reflector housing through an opening of the reflector such that a base plate projecting transversely to the longitudinal axis from the lamp base is pressed axially against an outer contact surface of the reflector housing. A collar surrounding the opening achieves that the lamp is centered. A contacting element provided from behind sees to the electrical contacting. A sleeve-type locking element is fastened to the reflector by means of a bayonet joint.

JP-A-2000077036 discloses a lamp for the headlight of a motor vehicle. This is a halogen lamp with a burner element and a lamp base. The lamp base is built up from a plurality of metal parts. A flange projecting laterally from the lamp base serves as an abutment for corresponding abutment surfaces of a reflector.

WO-98/08021 describes a lampholder of a headlight for motor vehicles. The lampholder constructed as part of the reflector housing has a prefocus ring as an abutment surface, against which a flange of the lamp is pressed from the exterior so as to achieve a reference position. An elastic retention ring is provided for this purpose, which bears axially on the lamp such that the flange is urged against the prefocus ring. The retention ring is fixed to the prefocus ring by means of a bayonet-type rotary locking mechanism.

WO-A-97/12385 describes a lamp which is suitable for motor vehicle lighting and which is positioned in a reflector. The lamp comprises a burner element which is fastened to a lamp base. In a headlight formed in this way, the lamp is passed through an opening in the reflector housing and is locked by rotation. The lamp base comprises a ring for this purpose, from which ring three locking studs project transversely to the longitudinal axis. The burner element and the lamp base with the cylindrical ring are axially introduced into a corresponding opening of the reflector housing during mounting of the lamp in the headlight, during which the locking projections are passed through recesses in the corresponding opening. A rotation after the passage of the locking projections causes the latter to be locked within the opening of the reflector housing. An elastic sealing ring serves as an axial resilient element. In addition, a transversely acting spring element is provided for an exact transverse positioning inside the opening of the reflector housing. Electrical contacting is achieved by means of a plug which is provided on contact lugs which extend either transversely or along the axis.

The bayonet-type closure of this lamp renders possible a very simple mounting. Both an axially and a transversely acting resilient element are present in the lamp base, so that no additional aids such as clamps, caps, springs, etc., are necessary. A very exact positioning can be achieved in that an interior reference position is reached, i.e. the abutment of the locking elements against the reflector on the inside.

DE-A-298 23 160 shows an adapter for connecting a H7 lamp. The connection contacts of the lamp inserted into the adapter are accommodated in bushes which are electrically connected to connection means arranged radially on the outside. The bushes are held to the lamp mount in a floating manner so as to achieve an exact positioning of the incandescent coil also in the case of manufacturing tolerances and mounting inaccuracies. The connection of the H7 lamp provided with the adapter to a reflector takes place in that the lamp is inserted into the mounting opening of the reflector. The exact positioning is achieved by abutting a plate disc against a corresponding abutment rim of the reflector. The electrical connection to plug contacts provided at the reflector can take place by rotation, during which the connection means arranged radially on the outside will enter contact shoes.

It is an object of the invention to provide a lamp of simple construction and an associated headlight wherein the lamp can be mounted to the reflector with very little expenditure.

According to the invention, the lamp base not only has locking means which project transversely to the longitudinal axis and which can be locked by a rotary movement, but also has transversely projecting contact elements which can come into contact with associated contact means of a reflector upon rotation during insertion of the lamp. A lamp according to the invention thus has the advantage that it can be connected both mechanically and electrically to an associated reflector in a particularly simple manner. The insertion of the lamp into a corresponding opening of the reflector and a subsequent rotation about the longitudinal axis are all that are necessary for achieving both the mechanical and the electrical connection. The mechanical locking and the electrical contacting are both achieved in one manual movement. Additional measures for the electrical connection, for example the insertion of plugs, have thus become redundant.

Nevertheless, the construction of the lamp according to the invention need not be more complicated than that of prior art lamps, for example in accordance with WO-97/12385. It suffices for the contact elements to project transversely such that they are moved by the rotation of the lamp about its longitudinal axis for the purpose of mechanical locking into a position in which they are in engagement with the contact means provided at the reflector. The angle of rotation between an insertion position of the lamp and the locking position, in which the contact elements are in engagement with the contact means, may be, for example, between 15° and 90°. Preferably, however, rotation angles of between 20° and 60°, and in particular angles in the range from 25° to 40°, are used.

The lamp may be either an incandescent lamp, for example a halogen incandescent lamp with one or two coils. Discharge lamps, however, may be equally well used.

The contact elements may here be, for example, two or three planar contact lugs (two for a single-filament lamp, three for a dual-filament lamp) which project perpendicularly to the longitudinal axis and which enter mating recesses acting as contact means owing to the rotation. The accommodation is preferably a resilient one, for example in a clamp-type recess, so as to safeguard that the electrical contact will be as good as possible.

In a further embodiment of the invention, the contact lugs enclose an angle with one another of approximately 60° each time. Three contact elements, which lie preferably in one plane, may thus be distributed over an angular range of approximately 120°, so that at least half the circumference remains free from contact elements.

In a yet further embodiment of the invention, a handle is provided at the lamp base. This handle serves to facilitate the handling of the entire lamp, in particular also the rotation for locking. The handle is preferably arranged at the axial end of the lamp. A simple raised portion which projects integrally from the rear closure of the lamp base may already suffice as a handle.

Other embodiments of the invention relate to resilient elements provided on the lamp. These are on the one hand axially acting resilient elements, which preferably act in a direction against the locking elements. Thus a portion of the reflector housing may be clamped between the resilient elements and the locking elements, whereby the lamp is fastened with clamping force against the reflector housing. It is also proposed on the other hand to provide a resilient element acting transversely to the longitudinal axis, which will ensure a retention within the mounting opening of the reflector housing, so that a defined transverse position will be occupied. The direct integration of these resilient elements with the lamp base renders it unnecessary for such elements to be separately provided during mounting.

The locking elements preferably comprise contact surfaces which lie in a common reference plane perpendicular to the longitudinal axis for achieving the exact positioning of the lamp with respect to the reflector housing. In a preferred embodiment, three locking elements constructed as lugs are provided with such contact surfaces. A configuration is preferred in which the locking elements bear with their contact surfaces on an inner surface of the reflector. The manufacture of an inner reference surface, i.e. on that part of the reflector which must be very accurately manufactured anyway because of its optical effect, will usually be possible with high accuracy.

It is proposed for a further embodiment that a snap projection is present at at least one of the locking elements, preferably at all locking elements. These projections may correspond to mating bulges or depressions on the inside of the reflector housing, so that a snap connection is formed—preferably under the influence of an axially acting resilient element—, resulting in an exactly defined rotational position.

An embodiment of the invention will be explained in more detail below with reference to the drawing, in which.

Figure 5:
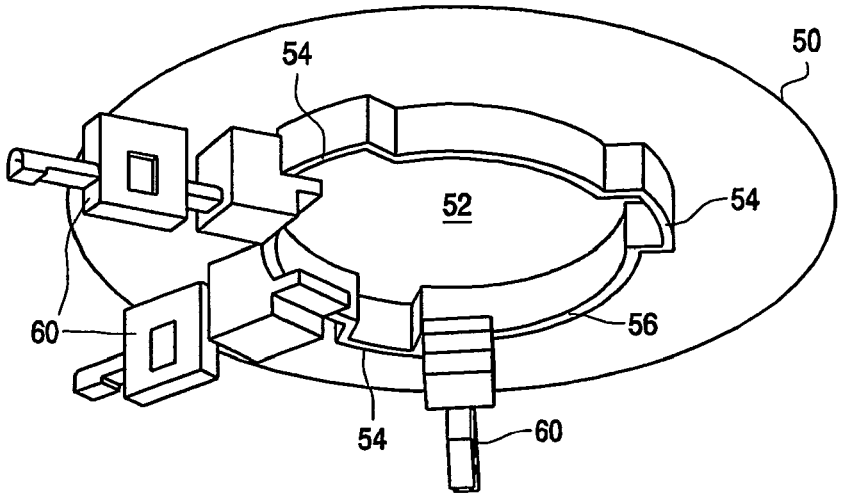
FIG. 5 is a perspective view of part of the exterior of a reflector housing.
Figure 5A:
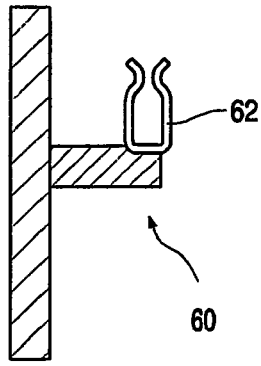
Figure 6:
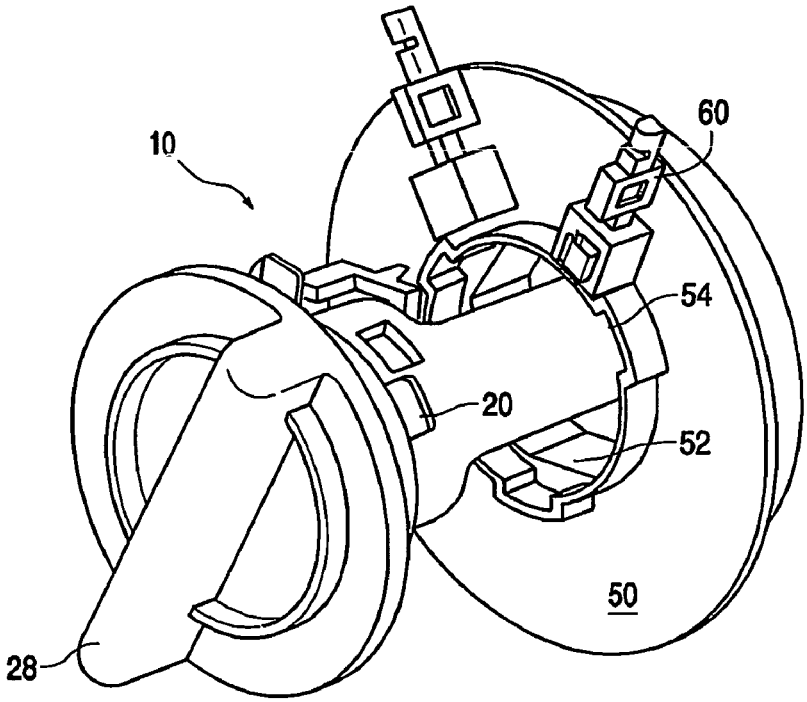
Figure 7:
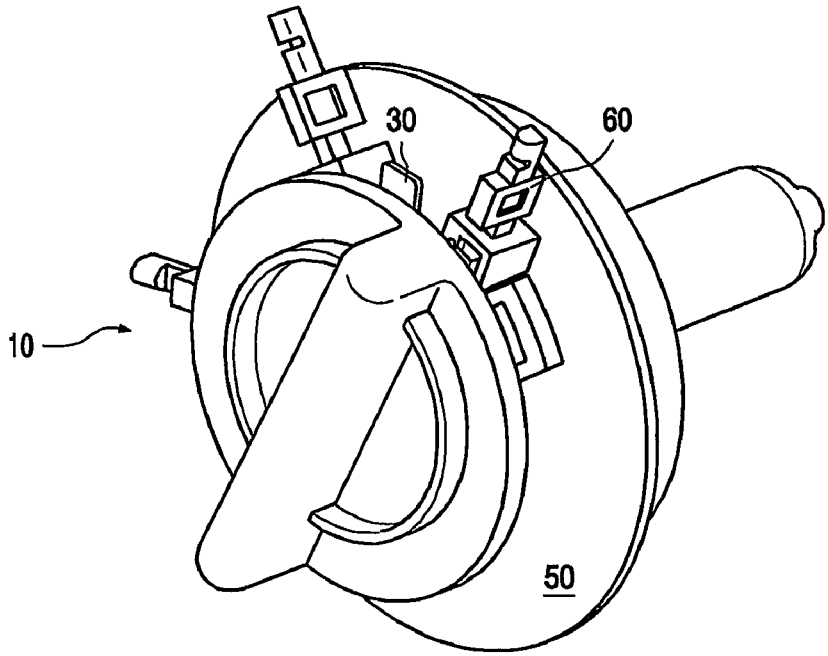
Figure 8:
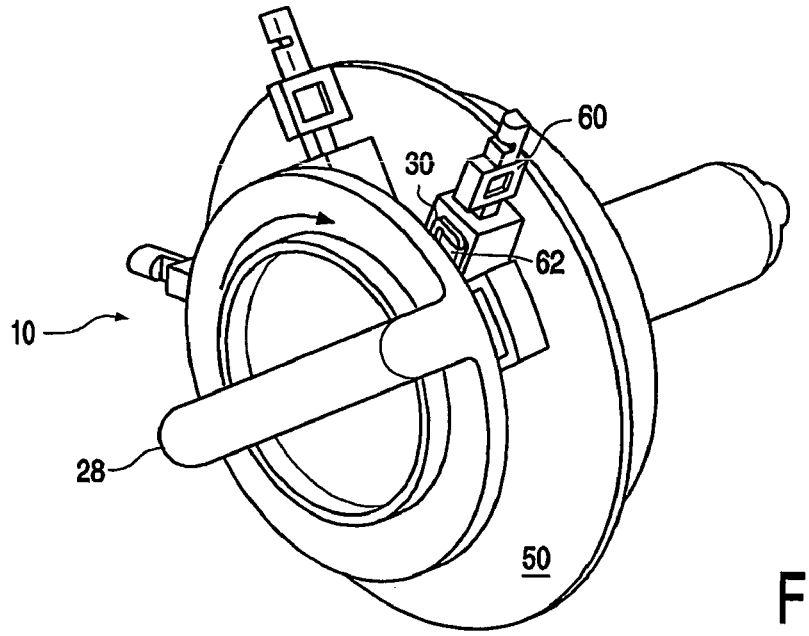
Figure 9:
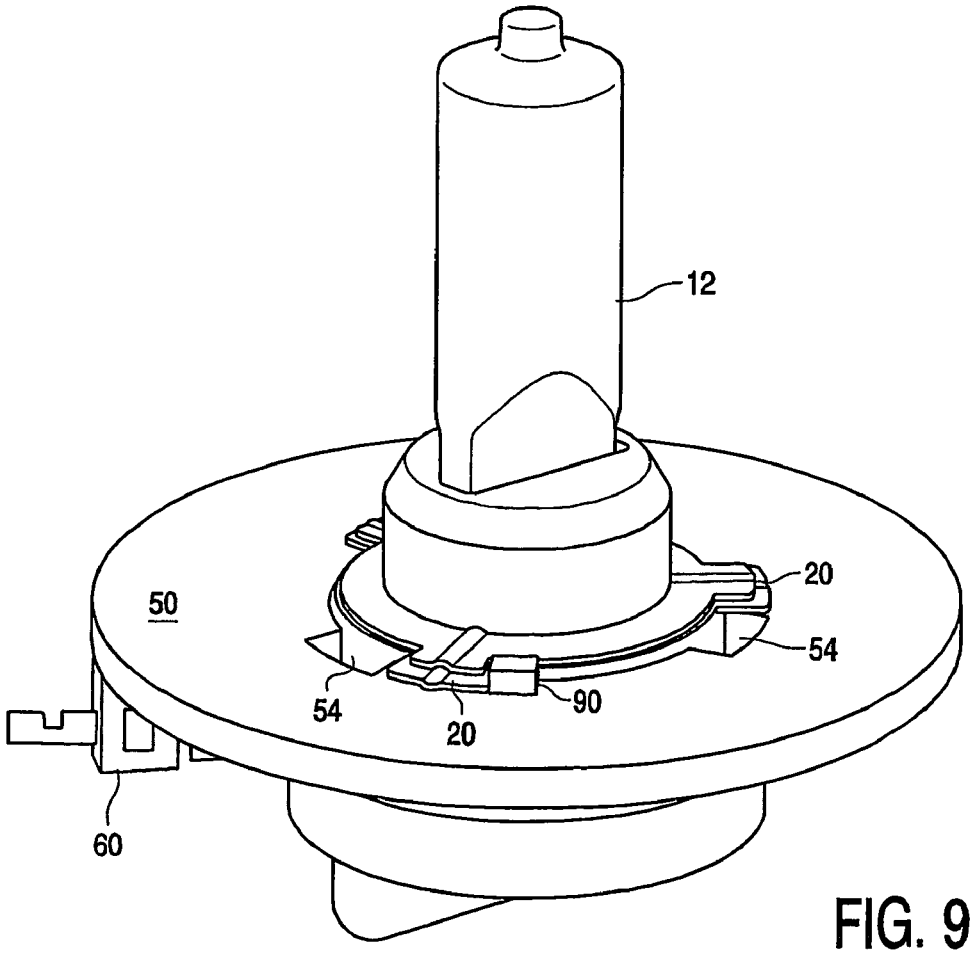

FIG. 5*a* is a cross-sectional view of part of the reflector housing with a contact holder;

FIGS. 6 to 8 are perspective views of the insertion of a lamp into a reflector housing, which is shown in part;

FIG. 9 is a perspective view of the lamp locked in a reflector housing; and

Figure 1:
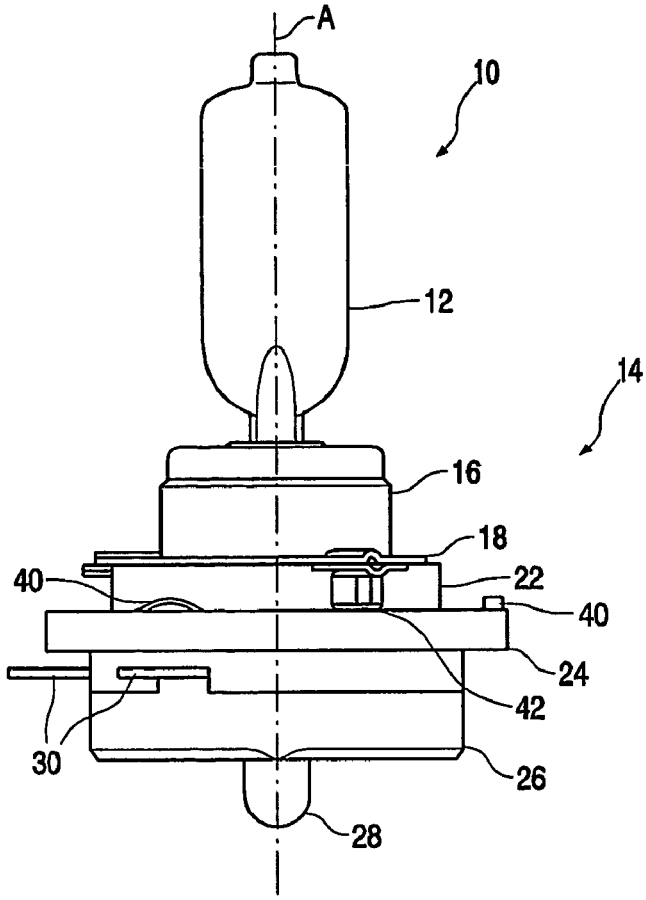
FIG. 1 is a side elevation of a lamp according to the invention.
Figure 2:
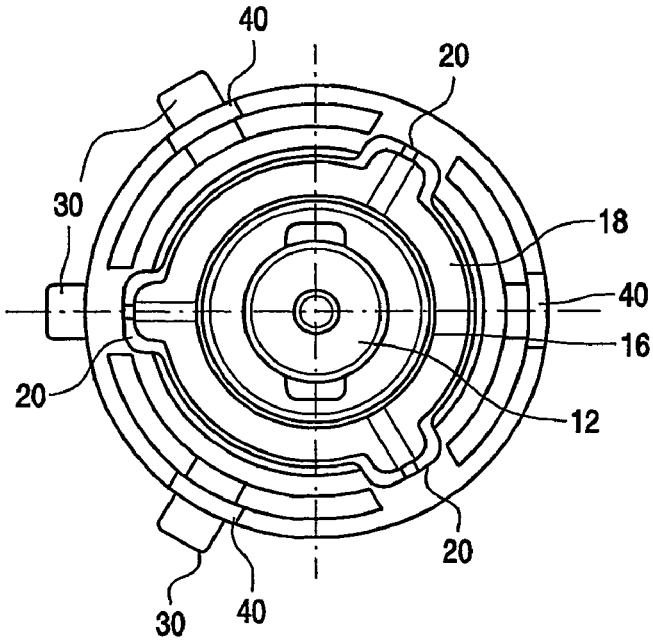
FIG. 2 is a plan view of the lamp of FIG. 1.
Figure 3:
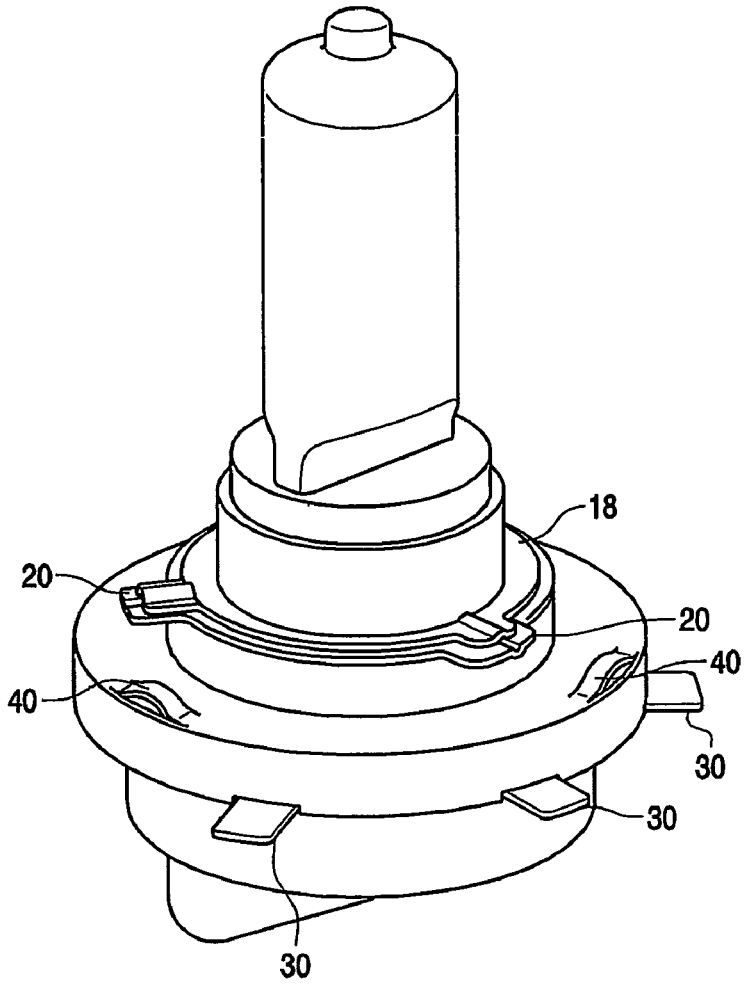
FIG. 3 is a perspective view of the lamp of FIG. 1.
Figure 10:
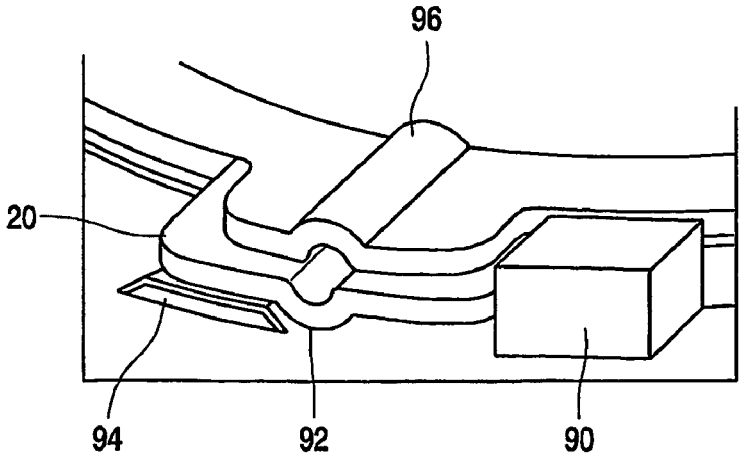
Figure 4:
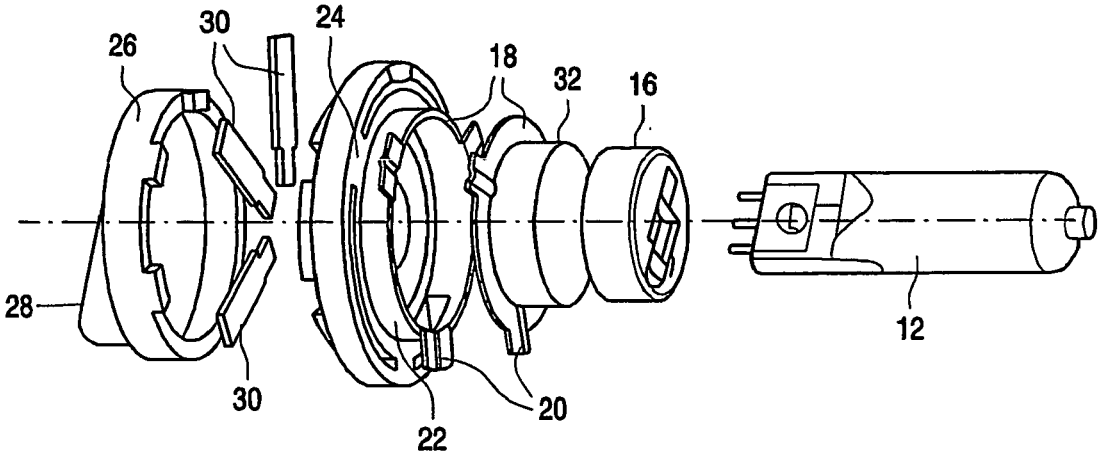
FIG. 4 is an exploded view of the lamp of FIG. 1.

FIG. 10 shows part of FIG. 9 on an enlarged scale.

FIGS. 1 to 4 show a lamp 10 with a burner element 12 and a lamp base 14. The burner element 12 in the example shown is a usual gas-filled glass bulb with two coils arranged therein. The lamp base 14 comprises a cylindrical front part 16 in which the burner element 12 is fastened, and a locking ring 18 with transversely projecting locking studs 20. In the direction of the central longitudinal axis A, the locking ring 18 is followed by a cylindrical region 22 and a flange 24. The lamp base is closed with a cap 26 provided with a handle 28.

Three planar, metal contact lugs 30 project from the synthetic resin cap 26. The contact lugs 30 are arranged in one plane so as to enclose an angle of 60° with one another each time. They are electrically connected to contacts leading to the burner element 12 inside the lamp base 14.

The locking studs 20 at the locking ring 18 are formed from two parts lying one on top of the other. A ring with a flange 32 lies against the frontmost lamp base part 16. The cylindrical ring 22 has three radially directed projecting studs 20, on which three studs 20 projecting from the flange 32 will lie. Three locking studs 20 are formed thereby, which are regularly distributed over the circumference and which are each of a double construction, formed from the projections of the parts 32 and 22. The shape of each locking stud 20 is made clear in FIG. 10: both the upper parts of the projections 20 formed from the flange part 32 and the parts formed from the lower ring 22 have curved portions 96, 92. As will be explained further below, the curved portions 92, 96 serve to lock the lamp base in a desired position against a reflector housing. The double construction of the locking studs 20 with curved portions 92, 96, both in axial forward and axial rear direction, render possible the use of lamps with a construction having an inner reference surface 92 with abutment against the inner surface of the reflector as well as with an outer reference surface 96 with abutment against an outer surface of the reflector.

Three axially acting spring elements are provided on the flange 24, formed as bent metal strips which project axially from the radial surface of the flange 24. The spring elements 40 act on the locking studs 20 in axial direction such that a reflector housing can be fastened between the spring elements 40 and the locking studs 20 with clamping force, as will be explained further below.

The lamp further comprises an axially acting spring element 42 which acts in transverse direction through a transverse window in the cylindrical region 22 of the lamp base 14.

The handle 28 is formed in one piece with the cap 26, which is fixedly connected to the lamp base. For this purpose, projections at a lower side enter corresponding recesses in the part forming the flange 24.

FIG. 5 shows part of a reflector housing. The overall shape of the reflector is not of relevance here. The Figure accordingly only shows a circular portion 50 of the housing with an opening 52 for the accommodation of the lamp 10. The opening 52 is a substantially circular opening with approximately rectangular recesses 54 in its circumference. Three of these rectangular recesses 54 are evenly distributed over the circumference. The recesses 54 correspond to the locking studs 20 of the lamp as regards their arrangement and size. The reflector housing is provided with a raised step 56 on the outer surface at the edge of the opening 52. Next to the raised step 56, there are three contact holders 60 which are fastened to projections of the outer surface of the housing 50 and to which cable connections (not shown) are fastened.

The contact holders 60, one of which is individually shown once more in FIG. 5*a*, each have a planar contact clamp 62 formed from spring steel. A three contact clamps 62 of the contact holders 60 lie in one plane. The contact holders 60 are electrically connected to the electrical system of the motor vehicle by means of connection cables.

FIGS. 6 to 8 show how the lamp 10 is inserted into the reflector housing 50 and is locked and electrically connected therein.

In FIG. 6, the lamp 10 has no contact yet to the reflector housing 50. The lamp 10, which is held, for example, by the handle 28 arranged at its rear end, is introduced with the burner element 12 forward into the opening 52. The lamp is in a rotary position during this such that the locking studs 20 will enter the recesses 54 of the opening 52, so that the front part of the lamp base 14 with the locking ring 18 can be passed through the opening 52.

This position is shown in FIG. 7. The lamp 10 is fully inserted into the opening 52 (now covered) of the reflector housing 50. It should be noted that the contact lugs 30, of which only one is visible in the perspective view of FIG. 7, are not in engagement with the contact holders 60 in the rotary position in which the insertion of the lamp 10 is possible, because of the mutual agreement in position of the locking studs 20 and the recesses 54. In the axial end position shown in FIG. 7, the spring elements 40 are pressed and tensioned against the edge of the opening 52.

To define the position in which the lamp can be inserted, the positions and dimensions of the studs 20 and the recesses 54 are coded such that the lamp can be inserted in only one defined rotational position. This is achieved by a suitable distribution of the studs and recesses over the circumference, or by different sizes or shapes of individual pairs of studs and recesses.

FIG. 8 shows the situation after rotation of the lamp 10 in the direction of the arrow. The rotation, which can be performed particularly easily by means of the handle 28, moves the visible frontmost contact lug 30 into the associated contact clamp 62 of the contact holder 60, so that the elastic limbs of the contact clamp 62 are now pressed onto the contact lug 30 on both sides, whereby a good electrical contact is achieved. The electrical contacting of the remaining two contact holders 60 (not visible) is achieved in the same manner.

As FIG. 9 shows in a perspective view of the inside of the reflector housing 50, the rotation of the lamp has locked the latter with its locking studs 20 against the inner surface of the reflector housing 50.

The locking studs 20 passed through the recesses 54 are fixed in the interior of the housing in axial direction after the rotation, while being pressed by the action of the spring elements 40 against the inner side of the reflector housing surrounding the opening 52.

As was explained above, the locking takes place by means of a rotation about the longitudinal axis. The angle of rotation is approximately 30° here. The rotation is limited by a stop 90 on the inner surface of the reflector housing 50.

FIG. 10 once more shows, on an enlarged scale, how a locking stud 20 is positioned on the surface of the housing 50. The stud 20 bears laterally on the stop 90. The lower rounded bulge 92 of the locking stud 20 was moved over the snap projection 94 during the rotation. After completion of the rotation against the stop 90, the axial force of the spring elements prevents the bulge 92 locked against the snap projection 94 from being moved back again.

In the position shown in FIG. 9, the spring element 42 forcibly retains the lamp base 14 of the lamp 10 within the opening 52 in transverse direction (not shown). The action of the spring element 42 in a given radial direction presses the lamp 10 against the wall of the opening 52 opposed to the spring element 42, so that an exact position is occupied.

The lamp 10 is thus mechanically held against the reflector housing 50 and at the same time exactly positioned in axial and transverse directions in the position shown in FIG. 9. The burner element 12 accordingly is in an exactly defined position inside the reflector. It is electrically connected to the electrical system of the motor vehicle via the contact elements 30 and the holders 60, and from there through connection cables.

An inner reference is used here for an exact axial positioning, i.e. the reference contact faces 92 provided at the locking elements 20 here bear on an inner face of the reflector housing 50. They cooperate with the spring elements 40 so as to form a clamping connection.

Alternatively, the lamp 10 may be provided in a reflector housing of different construction (not shown), in which an external reference is used. The upper surface of the locking stud 20 shown in FIG. 10, with the raised portions 96, is used for this purpose, for example, these raised portions on the three locking studs 20 forming a reference plane which bears on corresponding outer surfaces at the edge of an opening in an alternative reflector housing (not shown). This case indeed requires the use of an external locking element which presses the lamp 10 axially against the reflector housing. This is usually supported by an external, axially acting spring element (not shown).

The lamp 10 may be exactly aligned during manufacture in that the frontmost lamp base portion 16, which holds the burner element 12, is movable axially as well as transversely with respect to the ring 32 in which it will be accommodated. After the alignment has been completed and the burner element has been correctly aligned with reference to the reference planes (axial contact plane 92 and transverse cylindrical ring 22), the portion 16 can be fixed to the ring 32, for example by means of spot welding, preferably with a laser.

The invention may be summarized in that a lamp and a headlight comprising a reflector housing and a lamp are proposed. The lamp has a lamp base and a burner element, said lamp base forming locking means which project transversely to the longitudinal axis of the lamp. Said means can be locked by rotation after insertion of the lamp into an opening of the reflector housing. This rotation at the same time achieves the electrical connection in that contact elements projecting transversely to the longitudinal axis, preferably planar contact lugs, are brought into engagement with contact means on the reflector housing, preferably contact clamps.

Further embodiments of the invention relate inter alia to axially and transversely acting spring elements as well as to a handle for rotating the lamp.

The invention claimed is:

1. A lamp comprising:

a burner element for the generation of light, and a lamp base to which said burner element is fastened, wherein the lamp base comprises locking means for locking to a reflector housing, which means project from the lamp base transversely to the longitudinal axis such that the lamp base can be axially locked through rotation about the longitudinal axis, and wherein the lamp base comprises contact elements electrically connected to the burner element, which elements project transversely to the longitudinal axis such that they can be brought into electrical engagement with contact means upon rotation of the lamp base.

2. The lamp as claimed in claim 1, wherein at least one axially acting spring element is provided for clamping against the locking means.

3. The lamp as claimed in claim 1, wherein at least one spring element acting transversely to the longitudinal axis is provided.

4. The lamp as claimed in claim 1, wherein a handle is provided at the lamp base for rotating the lamp.

5. The lamp as claimed claim 1, wherein the contact elements comprise at least two contact lugs, which enclose an angle of approximately 60° with one another each time.

6. The lamp as claimed in claim 1, wherein the contact elements are constructed as planar lugs, which are arranged in a common plane perpendicular to the longitudinal axis.

7. The lamp as claimed in claim 1, wherein the locking means have contact faces, which lie in a common reference plane which is perpendicular to the longitudinal axis.

8. A headlight comprising:

a reflector housing with an opening, and a lamp inserted into the opening the lamp having a burner element and a lamp base, such that the burner element projects into the interior of the reflector housing, wherein the lamp base is locked to the opening of the reflector housing by locking means which project from the lamp base transversely to the longitudinal axis such that the lamp base after insertion into the opening is axially locked through rotation about the longitudinal axis, and wherein the lamp base comprises contact elements which are electrically connected to the burner element and which are in electrical contact with electrical contact means provided at the reflector housing, and wherein the contact elements project transversely to the longitudinal axis of the lamp and are brought into electrical engagement with the contact means through rotation of the lamp base.

9. The headlight as claimed in claim 8, wherein the locking means bear on an inner face of the reflector.

10. The headlight as claimed in claim 8, wherein at least one of the locking means comprises a snap projection which extends in axial direction.

11. The headlight as claimed in claim 8, wherein contact means provided at the reflector are in resilient contact with the contact elements of the lamp.

12. A lamp comprising:

a burner; and a base for holding the burner, wherein said base includes at least one stud projecting away from said base, and at least one lug projecting transversely from a longitudinal axis of said base and being configured for electrical connection with contacts of a housing;

said at least one lug being configured to provide said electrical connection upon insertion of said base into an opening of said base and rotation of said base.

13. The lamp of claim 12, wherein said at least one stud is configured to mechanically attach said base to said housing upon said rotation.

14. The lamp of claim 12, wherein said base includes a resilient element for providing a resilient force on an outer surface of said housing.

15. The lamp of claim 14, wherein said at least one stud, in cooperation with said resilient element, provides a resilient force on an inner surface of said housing.

16. The lamp of claim 12, wherein said base includes a resilient element configured to provide a resilient force against said housing in cooperation with said at least one stud.

17. The lamp of claim 12, wherein said housing includes a stop configured to end said rotation.

18. The lamp of claim 17, wherein said housing includes a snap configured to abut against a curved portion of said at least one stud upon reaches said stop.

19. The lamp of claim 12, further comprising a handle connected to said base, said handle being configured for facilitating said rotation.

* * * * *